US007537436B2

(12) United States Patent
Kitamura et al.

(10) Patent No.: US 7,537,436 B2
(45) Date of Patent: May 26, 2009

(54) COMPRESSOR

(75) Inventors: Takeo Kitamura, Kusatsu (JP); Kenji Watanabe, Moriyama (JP); Takeshi Kawata, Otsu (JP); Okuzono Kenji, Otsu (JP); Tsuchida Nobunao, Kusatsu (JP)

(73) Assignee: Panasonic Corporation, Osaka (JP)

( * ) Notice: Subject to any disclaimer, the term of this patent is extended or adjusted under 35 U.S.C. 154(b) by 432 days.

(21) Appl. No.: 10/507,029

(22) PCT Filed: Mar. 11, 2003

(86) PCT No.: PCT/JP03/02837

§ 371 (c)(1),
(2), (4) Date: Sep. 8, 2004

(87) PCT Pub. No.: WO03/081043

PCT Pub. Date: Oct. 2, 2003

(65) Prior Publication Data

US 2005/0106041 A1 May 19, 2005

(30) Foreign Application Priority Data

Mar. 12, 2002 (JP) ..... 2002-066475

(51) Int. Cl.
*F01C 21/04* (2006.01)

(52) U.S. Cl. ..... 417/313; 418/97; 418/DIG. 1

(58) Field of Classification Search ..... 417/313
See application file for complete search history.

(56) References Cited

U.S. PATENT DOCUMENTS

| | | | | |
|---|---|---|---|---|
| 6,152,713 | A * | 11/2000 | Hisanaga et al. | 418/55.2 |
| 6,179,578 | B1 * | 1/2001 | Kayukawa et al. | 417/313 |
| 2001/0029727 | A1 * | 10/2001 | Iwanami et al. | 55/459.1 |
| 2004/0170517 | A1 * | 9/2004 | Kawata et al. | 418/97 |

FOREIGN PATENT DOCUMENTS

| | | |
|---|---|---|
| EP | 0 899 460 | 3/1999 |
| EP | 0 965 804 | 12/1999 |
| JP | 8-151990 | 6/1996 |
| JP | 11-42444 | 2/1999 |
| JP | 11-082352 | 3/1999 |
| JP | 2001-295767 | 10/2001 |

* cited by examiner

*Primary Examiner*—Devon C Kramer
*Assistant Examiner*—Philip Stimpert
(74) *Attorney, Agent, or Firm*—Wenderoth, Lind & Ponack, L.L.P.

(57) ABSTRACT

A compressor comprises a compressing mechanism for compressing a fluid that contains lubricating oil, and a separation chamber that is to have revolved therein fluid compressed by the compressing mechanism, wherein at least part of the lubricating oil contained in the fluid is separated by centrifugal force produced by this revolution, and wherein only this introduced fluid is present in the separation chamber.

2 Claims, 7 Drawing Sheets

COMPRESSOR

TECHNICAL FIELD

The present invention relates to a compressor used in an air conditioner for an automobile or the like, from among compressors for compressing refrigerant.

BACKGROUND ART

In a compressor for compressing fluid, part of lubricating oil for lubricating sliding parts of a compressing mechanism is discharged from the compressor together with compressed fluid, and circulates during a refrigerating and air conditioning cycle. As a quantity of lubricating oil discharged into the fluid during the cycle increases, system efficiency (heat efficiency) declines. Accordingly, to enhance the system efficiency, contained lubricating oil is separated as much as possible from the fluid compressed by the compressing mechanism. This separated fluid is discharged into a system cycle. Such examples are disclosed in Japanese Laid-open Patent No. H11-82352 (FIG. 1, FIG. 3, FIG. 4), and Japanese Laid-open Patent No. 2001-295767 (FIG. 1, FIG. 2). In such a conventional compressor comprising a centrifugal separation chamber, high pressure refrigerant gas containing lubricating oil compressed by a compressing mechanism is guided into a centrifugal separation chamber. This refrigerant gas revolves in this circular columnar separation chamber. By centrifugal force of this revolution, misty lubricating oil contained in the refrigerant gas contacts an inner wall of the separation chamber. As a result, the misty lubricating oil is separated from the refrigerant gas. This conventional compressor comprising the centrifugal separation chamber has a pipe called a separation pipe provided in the separation chamber. The refrigerant gas introduced into the separation chamber revolves in a cylindrical space of circular section formed between an outer circumference of the separation pipe and an inner circumference of the separation chamber. Thus, in a centrifugal lubricating oil separation system, generally, a separation pipe is regarded to be an essential constituent element. That is, to enhance separation efficiency of lubricating oil, refrigerant gas must be revolved securely in the separation chamber. For this purpose, it is considered essential to install a separation pipe in the separation chamber and revolve the refrigerant gas along the circumference. Such system of installing a separation pipe in the separation chamber results in a large-sized separation chamber. Moreover, a number of parts is increased, and manufacturing cost of the separation chamber is raised as is a number of processes increased for assembling the separation pipe, whereby it is a serious problem to reduce manufacturing costs of the compressor.

It is hence an object of the invention to solve these conventional problems and present a compressor high in terms of separation efficiency of lubricating oil, reduced in terms of a size of a compression chamber, and lowered in terms of manufacturing cost.

SUMMARY OF THE INVENTION

The invention presents a compressor comprising a compressing mechanism for compressing a fluid that contains lubricating oil, and a separation chamber that is to have revolved therein fluid compressed by the compressing mechanism, and in which at least part of lubricating oil contained in the fluid is separated by centrifugal force produced by this revolution, in which only this introduced fluid is present in the separation chamber.

DETAILED DESCRIPTION OF THE PREFERRED EMBODIMENTS

A preferred embodiment of the invention is described below while referring to the accompanying drawings. Drawings are schematic diagrams, and do not represent a configuration of parts in correct dimensions.

Preferred Embodiment

Figure 1:
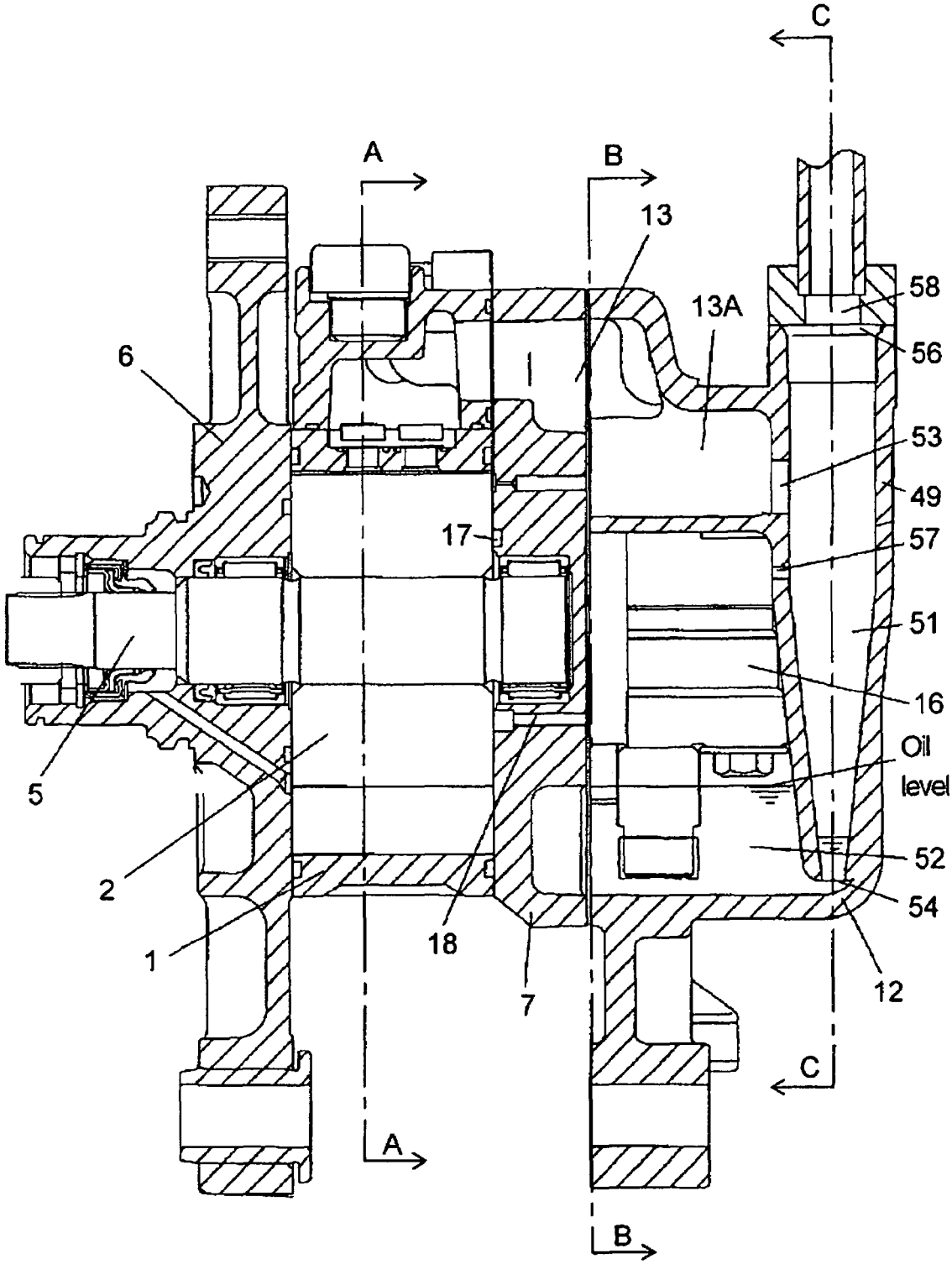
FIG. 1 is a longitudinal sectional view showing an example of a compressor in a preferred embodiment.
Figure 2:
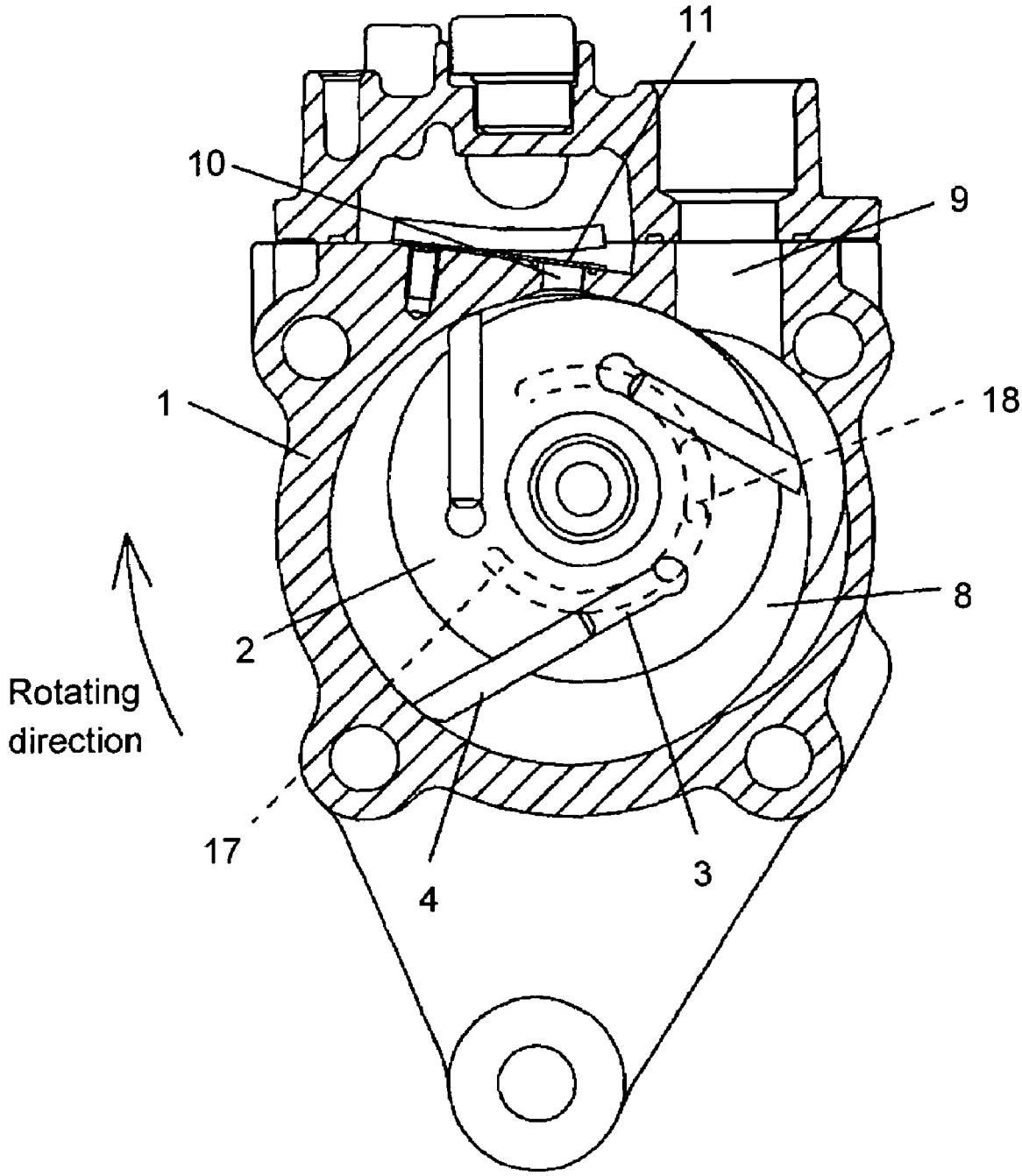
FIG. 2 is a sectional view along A-A (operation chamber sectional view) of the compressor shown in FIG. 1.
Figure 3:
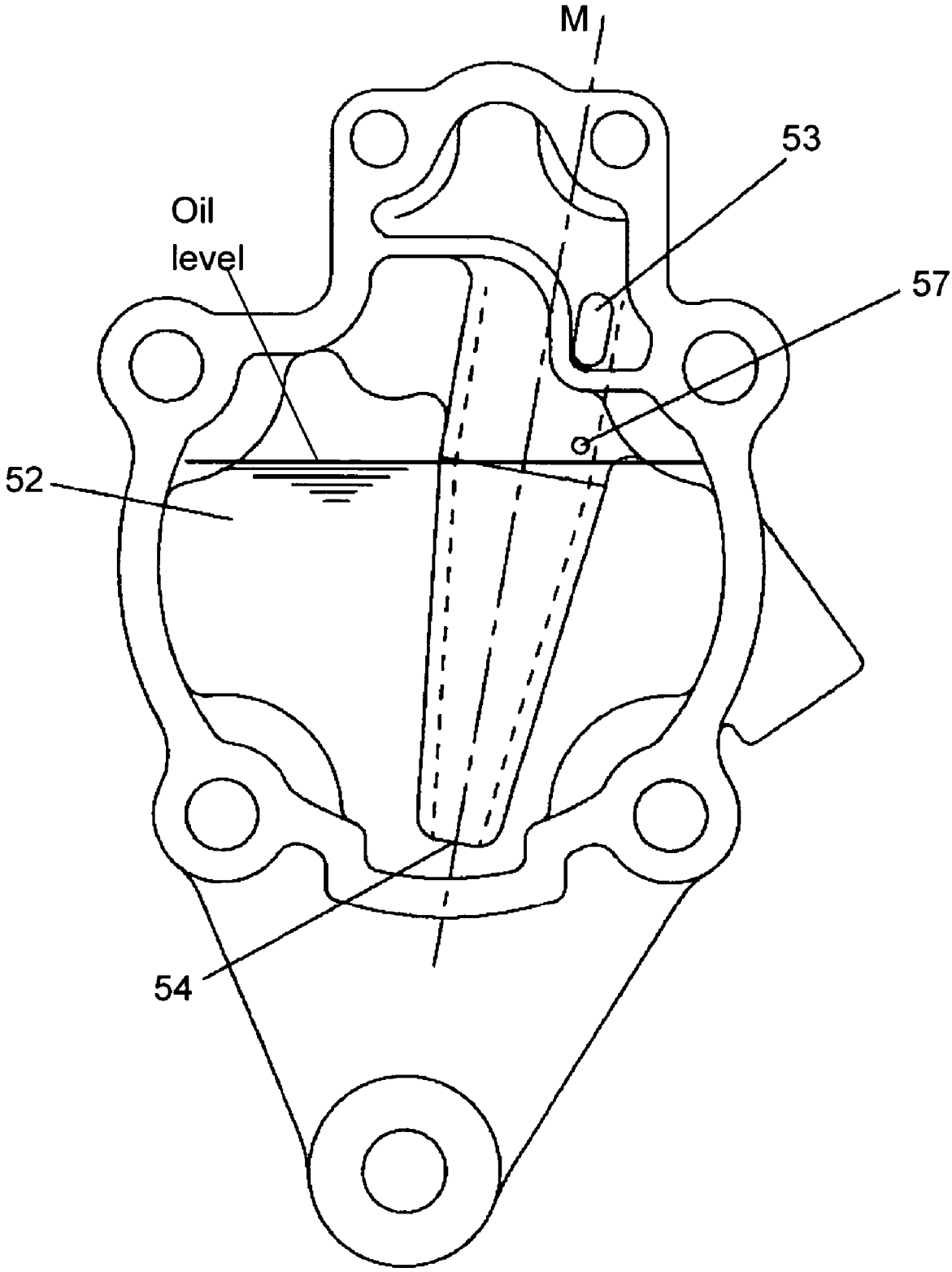
FIG. 3 is a sectional view along B-B (high pressure case seen from operation chamber side) of the compressor shown in FIG. 1.

A compressor shown in FIG. 1 to FIG. 3 is a so-called vane rotary type compressor, and circular columnar rotor 2 is disposed in cylinder 1 having a cylindrical inner wall. Rotor 2 is disposed at such a position that part of its outer circumference may form a slight gap with the inner wall of cylinder 1.

Rotor 2 includes a plurality of vane slots 3. Vane 4 is slidably inserted in each vane slot 3.

Rotor 2 is formed integrally with driving shaft 5 which is rotatably supported. Cylinder 1 and rotor 2 are inserted between front plate 6 and rear plate 7 in a rotary shaft direction of rotor 2.

Both ends of cylinder 1 are closed by plates 6 and 7, and operation chamber 8 is formed in cylinder 1 for compressing a fluid.

Suction port 9 and discharge port 10 communicate with operation chamber 8. Fluid such as refrigerant gas is sucked from suction port 9 into operation chamber 8, and compressed and discharged from discharge port 10. At an outlet of discharge port 10, discharge valve 11 composed of, for example, a reed valve is disposed.

High pressure case 12 is installed at a rear side of rear plate 7.

High pressure case 12 includes separation chamber 51 for separating and collecting misty lubricating oil contained in the refrigerant gas compressed in operation chamber 8. The fluid compressed in operation chamber 8 and discharged from discharge port 10 flows into guide passage 13 provided continuously in cylinder 1, rear plate 7 and high pressure case 12. The fluid further passes through feed hole 53 formed in a side wall of separation chamber 51, and flows into separation chamber 51.

In an upper part of separation chamber 51 is a gas exhaust hole 58 for exhausting refrigerant gas from which lubricating oil has been separated in separation chamber 51.

In a lower part of separation chamber 51 is an oil discharge hole 54 for discharging lubricating oil separated from refrigerant gas and collected in separation chamber 51.

The refrigerant gas exhausted through gas exhaust hole 58 from separation chamber 51 circulates in a refrigerating and air conditioning cycle. The refrigerant gas returns to suction port 9, and is compressed again and circulates in the refrigerating and air conditioning cycle.

Oil discharge hole 54 in the lower part of separation chamber 51 communicates with oil-storage chamber 52 formed between high pressure case 12 and rear plate 7. Therefore, the lubricating oil separated from the refrigerant gas in separation chamber 51, and collected, passes through oil discharge hole 54 and is stored in oil-storage chamber 52.

The lubricating oil stored in oil-storage chamber 52 is supplied to rotor 2, vane 4, the inner wall of cylinder 1 and other parts through oil-supply passage 18, and lubricates these parts. The lubricating oil is further supplied into vane back pressure chamber 17, and works to force vane 4 to outside of rotor 2 by its pressure.

The lubricating oil is supplied through oil-supply passage 18 for supplying lubricating oil from oil-storage chamber 52 into a compressing mechanism. In oil-supply passage 18, the lubricating oil stored in oil-storage chamber 52 is supplied through vane back pressure adjusting apparatus 16. Depending on a refrigerant gas pressure around the compressing mechanism, vane back pressure adjusting apparatus 16 controls a feed pressure and feed amount of lubricating oil to be supplied into the compressing mechanism.

Operation of the compressor in this preferred embodiment is described below.

Receiving power transmission from a driving source such as car-mount engine, as shown in FIG. 2, driving shaft 5 and rotor 2 rotate clockwise. By this rotation, refrigerant gas of low pressure flows into operation chamber 8 from suction port 9.

Along with rotation of rotor 2, compressed refrigerant gas of high pressure pushes up discharge valve 11 from discharge port 10, and flows into guide passage 13. Further, refrigerant of high pressure passes through feed hole 53, and flows into separation chamber 51. In separation chamber 51, lubricating oil contained in the refrigerant gas is separated and collected. Separation chamber 51 shown in FIG. 1 is a so-called centrifugal oil separator. It is composed by mutually coupling circular columnar space 49 and an inverted conical space.

An interior of the separation chamber 51 does not include a separation pipe used in a conventional centrifugal compressor. Thus, the interior of the separation chamber is a hollow space, and only introduced refrigerant gas (partly mixed with lubricating oil contained in the compressor) is present. Further, the interior of separation chamber is free from bumps and dents which may disturb revolution of refrigerant gas introduced into separation chamber 51. Feed hole 53 is disposed eccentrically from a central axis of circular columnar space 49 of separation chamber 51. The refrigerant gas introduced into separation chamber 51 is guided in a tangential direction of circular columnar space 49. That is, the refrigerant gas flows into separation chamber 51 along an inner circumference of circular columnar space 49 so as to revolve in a direction of revolution. Therefore, the refrigerant gas introduced into separation chamber 51 revolves in a peripheral direction in separation chamber 51. By a centrifugal force of revolution, lubricating oil of heavier specific gravity contacts with an inner wall of separation chamber, and is separated from the refrigerant gas.

This separated lubricating oil moves down along the inner circumference of circular columnar space 49, and is collected in a center of the inverted conical space.

Between an upper part of oil-storage chamber 52 and separation chamber 51, communication passage 57 is provided for communicating mutually with these chambers. Like feed hole 53, communication passage 57 is provided eccentrically from the central axis of separation chamber 51.

In this structure, fluid introduced into separation chamber 51 through communication passage 57 is guided in the tangential direction of circular columnar space 49. That is, the fluid flows into separation chamber 51 along the inner circumference of circular columnar space 49. The communication passage 57 opens in the tangential direction of the circular columnar space 49, or interior space, so that any fluid flowing into the interior space via the communication passage 57 from the upper part of the oil-storage chamber is aligned with the direction of revolution at a point of introduction into the interior space. That is, the feed hole 53 and the communication passage 57 introduce fluid into the interior space in the same circumferential direction. As a result, the fluid flowing into separation chamber 51 from oil-storage chamber 52 through communication passage 57 smoothly converges on revolution of refrigerant gas in separation chamber 51. That is, disturbance of revolution of refrigerant gas can be suppressed. If the lubricating oil in oil-storage chamber 52 reaches up to communication passage 57 due to some cause, the lubricating oil is guided into separation chamber 51 by way of communication passage 57. Since a flowing direction of lubricating oil into separation chamber 51 is a direction to converge on a revolving flow in separation chamber 51 as mentioned above, revolution of refrigerant gas in separation chamber 51 is not disturbed.

In a case of the compressor of this preferred embodiment, an opening at an oil-storage chamber side of oil discharge hole 54 is positioned below an oil level in oil-storage chamber 52 in a perpendicular direction.

Accordingly, refrigerant gas of high pressure discharged from the compressing mechanism acts to push down an oil level of lubricating oil collected in the lower part of separation chamber 51, and also push up the oil level of lubricating oil in oil-storage chamber 52.

However, when the lubricating oil in oil-storage chamber 52 is pushed up, fluid (mainly refrigerant gas) gathering in the upper part of oil-storage chamber 52 may disturb elevation of the oil level of lubricating oil in oil-storage chamber 52.

In this preferred embodiment, between the upper part of the oil-storage chamber 52 and separation chamber 51, communication passage 57 is provided for allowing fluid to move freely therebetween. Communication passage 57 functions as a gas vent hole for fluid such as refrigerant gas gathering in the upper part of oil-storage chamber 52. As a result, the oil level of lubricating oil in oil-storage chamber 52 can be pushed up smoothly.

Communication passage 57 is provided so that the fluid flowing into separation chamber 51 from oil-storage chamber 52 may not disturb revolution of refrigerant gas in separation chamber 51. For this purpose, a flowing direction of fluid from oil-storage chamber 52 into separation chamber 51 should not have a directional component facing and colliding with a revolving flow near an outlet of communication passage 57. Therefore, the communication passage 57 may be provided along a direction orthogonal to the central axis of separation chamber 51.

In the preferred embodiment, an opening of oil discharge hole 54 at a side of oil-storage chamber 52 is positioned lower than the oil level in oil-storage chamber 52 in a perpendicular direction. However, the opening may also be positioned higher than the oil level.

In this case, an oil level push-up effect by refrigerant gas of high pressure is not expected. However, since communication passage 57 is provided, blow-back from oil discharge hole 54 by pulsation of refrigerant gas can be suppressed. Therefore, expected to be suppressed is scattering of oil, collected in the lower part of separation chamber 51, into the separation chamber by blow-back.

It is a feature of the compressor of the invention that a separation pipe is not provided in separation chamber 51 in spite of this structure having a so-called centrifugal separation chamber. Elimination of the separation pipe is realized by the following four technical factors.

A first factor is a relative configuration of a feed hole for feeding compressed refrigerant gas into separation chamber 51, and the separation chamber. The relative configuration refers to a degree of eccentricity of the feed hole from the central axis of the separation chamber. The degree of eccentricity is specifically described below.

Figure 4:
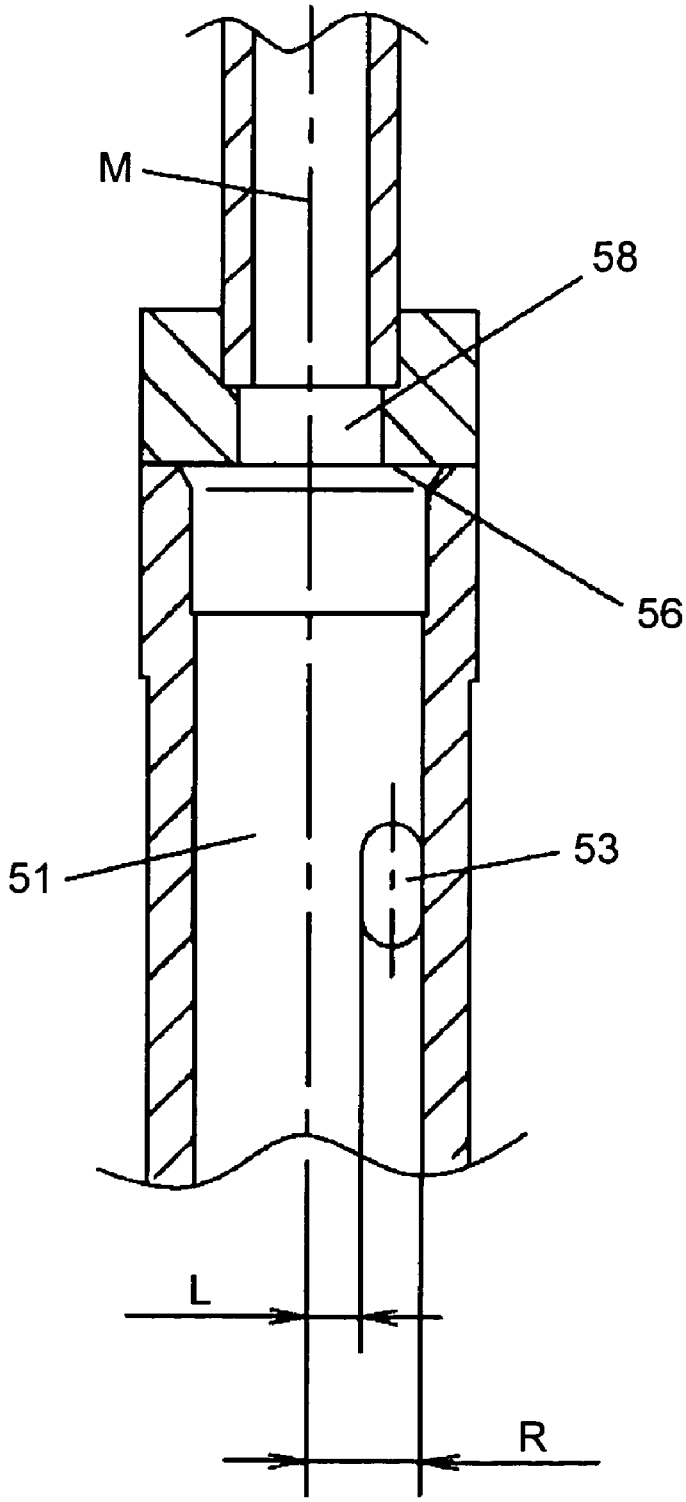
FIG. 4 is a sectional view along C-C near a separation chamber of the compressor shown in FIG. 1.

As shown in FIG. 4, suppose a distance from central axis M of separation chamber 51 to the inner peripheral wall of circular columnar space 49 to be R. Further, suppose a shortest distance from central axis M to a projection line of lead hole 53 projected in a tangential direction (direction parallel to a central axial line of feed hole) of columnar circular space 49 to be L. When thus defined, a ratio of L to R (L/R) is the degree of eccentricity. Assuming a range of value of L to be 0 at minimum and R at maximum, the degree of eccentricity (L/R) is a value from 0 to 1.

The larger this value, the more eccentric is the feed hole relative to the separation chamber. A relationship between the degree of eccentricity and oil circulation rate (OCR) is compared between a case having a separation pipe in the separation chamber and a case not having such a pipe in the separation chamber. This relationship is qualitatively shown in FIG. 5.

Figure 5:
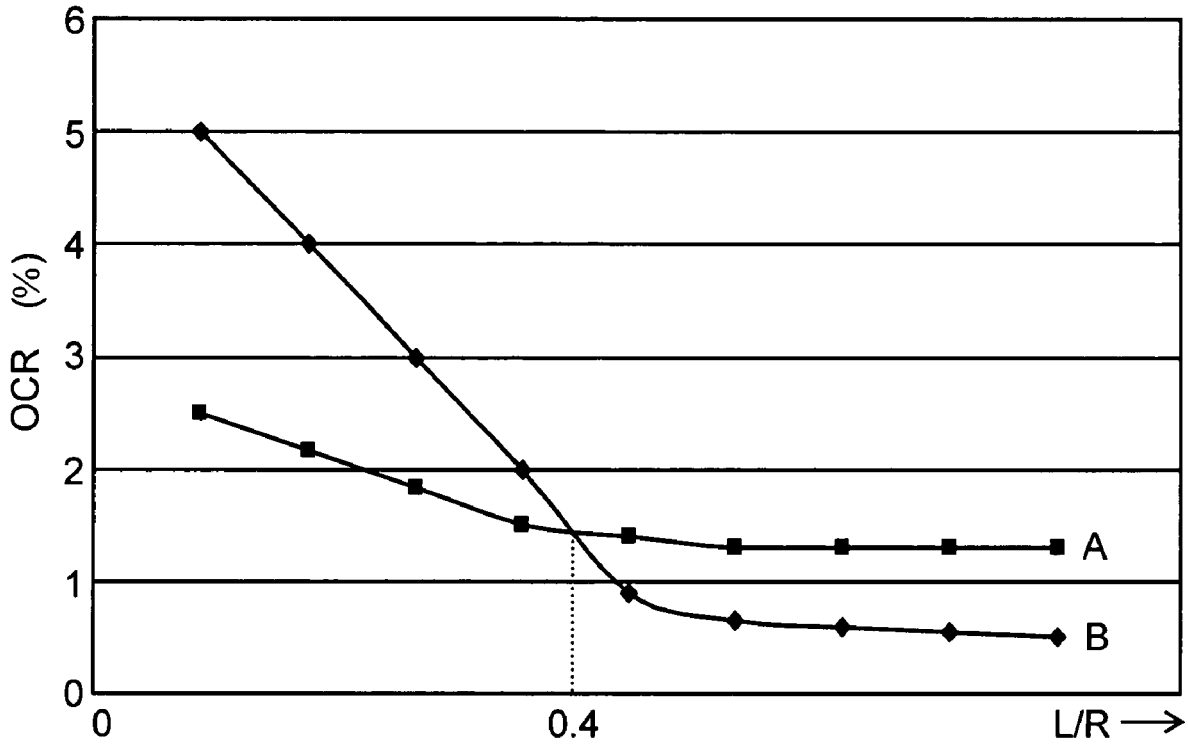
FIG. 5 is a diagram showing a relationship between degree of eccentricity (L/R) of a feed hole in the separation chamber and oil circulation rate (OCR).

OCR is defined in Japanese Industrial Standards (JIS B 8606). That is, OCR represents a mass of lubricating oil relative to a mass of a mixed solution of liquid refrigerant and lubricating oil that lubricates during a cycle, and is represented as a percentage. A smaller value of OCR shows a higher oil separation efficiency. In FIG. 5, curve A represents the case with a separation pipe in the separation chamber and curve B represents the case without a separation pipe in the separation chamber. As shown in FIG. 5, in a region of a small degree of eccentricity, the OCR is smaller in the case with the separation pipe in the separation chamber. As the degree of eccentricity becomes higher, the OCR difference narrows, and curve A and curve B intersect. At a higher degree of eccentricity, the OCR values of curve A and curve B are inverted. Therefore, to present a refrigerating and air conditioning system of high efficiency by eliminating a separation pipe, it is preferred to define the degree of eccentricity higher than the degree of eccentricity corresponding to the intersection of both curves shown in FIG. 5. The present inventors discovered by simulation that a preferred degree of eccentricity (L/R) should be at least 0.4. Alternatively, L may be defined as a distance from the central axis M of the separation chamber to an axis of a center of gravity section of the feed hole. In this case, the degree of eccentricity may be at least 0.7 but is variable depending on a shape of the feed hole. Thus, a refrigerating and air conditioning system of higher efficiency (lower OCR) is presented without using a separation pipe in the separation chamber as compared with the case having such a pipe in the separation chamber.

A second factor is a configuration of gas exhaust hole 58 for exhausting refrigerant gas after separation of oil from the separation chamber, and a configuration of an opening of separation chamber 51. In the preferred embodiment shown in FIG. 1, gas exhaust hole 58 is provided in a central part of an upper end side of circular columnar space 49 of separation chamber 51.

A sectional area of gas exhaust hole 58 is formed smaller than a sectional area of circular columnar space 49. Gas exhaust hole 58 does not reach up to an outer circumference of circular columnar space 49. At an upper end of circular columnar space 49, reducing portion 56 is formed for reducing an inside diameter of circular columnar space 49 to an inside diameter of gas exhaust hole 58. That is, gas exhaust hole 58 is coupled to the upper end side outer circumference of circular columnar space 49 by way of this reducing portion 56. Thus, suppressed is escape of refrigerant gas, of high density and high speed containing much lubricating oil mist and introduced into separation chamber 51, from the separation chamber by hardly revolving in separation chamber 51. That is, assuming a flow velocity of refrigerant gas introduced into the separation chamber not to decline while revolving, the refrigerant gas (of high density) containing much lubricating oil mist of high specific gravity revolves around an outer circumference of this revolving flow along the inner wall of circular columnar space 49. As separation of lubricating oil is promoted, the oil gradually moves into a center of revolution as being pushed away by the refrigerant gas of high density. Finally, gas is considered to be exhausted from the gas exhaust hole.

Actually, the refrigerant gas right after being introduced in the separation chamber is fastest in terms of flow velocity, and the flow velocity declines gradually during revolution. As the flow velocity declines, a centrifugal force acting on the refrigerant gas decreases. Accordingly, the refrigerant gas of high density and high speed containing lubricating oil mist revolves on the outer circumference of the revolving flow along circular columnar space 49 in the separation chamber. As separation of lubricating oil is promoted, the refrigerant gas lowered in density and speed moves into a center of revolution, and is exhausted from the gas exhaust hole. Thus, suppressed is escape of refrigerant gas, of high density and high speed containing much lubricating oil mist and introduced into separation chamber, from the separation chamber by hardly revolving in separation chamber 51. In the preferred embodiment shown in FIG. 1 and FIG. 4, reducing portion 56 is formed as an upper end at a right angle to the central axis of circular columnar space 49. However, it is not always limited to this structure. The reducing portion 56 may be formed as a slope inclined obliquely to the central axis of the circular columnar space. The reducing portion may also be formed as a moderate curve consecutive from the outer circumference of the circular columnar space. As long as the reducing portion is present along an entire circumference of gas exhaust hole 58, a central axis of the gas exhaust hole may be eccentric relative to the central axis of separation chamber 51.

Figure 6:
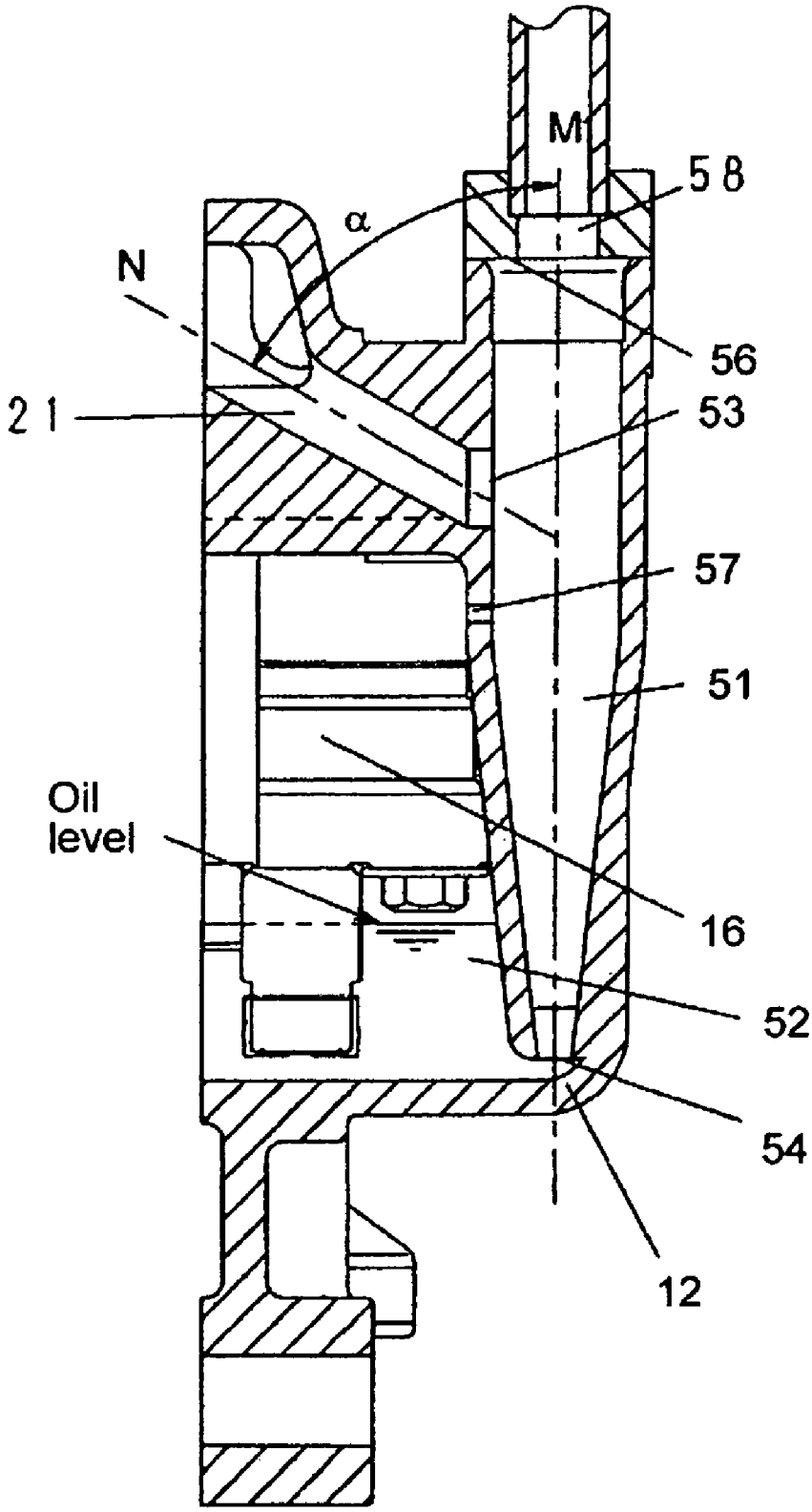
FIG. 6 is a longitudinal sectional view showing another example of a high pressure case of the preferred embodiment of FIG. 1.

A third factor is adjustment of direction of slender passage 21 communicating with feed hole 53 as shown in FIG. 6. That is, refrigerant gas introduced into separation chamber 51 flows in separation chamber 51 in a direction departing (downwardly away) from gas exhaust hole 58. In this manner, at least refrigerant gas containing much lubricating oil mist and right after being introduced into separation chamber 51 can be moved away from gas exhaust hole 58. Thus, the refrigerant gas containing much lubricating oil mist right after introduction can be suppressed from being supplied into the refrigerating and air conditioning system from gas exhaust hole 58.

Meanwhile, if inclination angle $\alpha$ of central axis N of slender passage 21 and central axis M of separation chamber 51 is too small, flow velocity of refrigerant gas introduced into separation chamber 51 cannot be utilized during revolution in separation chamber. As a result, it is considered that the OCR may drop. In order to obtain a high OCR, inclination angle α is preferred to be at least 60 degrees to at most 90 degrees.

The circular columnar space expands in a direction away from the gas exhaust hole, and an inner wall of the columnar space is formed. As a result, refrigerant gas of high density and high speed introduced into separation chamber 51 receives a centrifugal force, and is guided into a most expanded inner circumference. Hence, inclining slender passage 21 relative to central axis M of separation chamber 51 is preferable because the refrigerant gas containing much lubricating oil mist and introduced in the separation chamber can be departed from gas exhaust hole 58.

Figure 7:
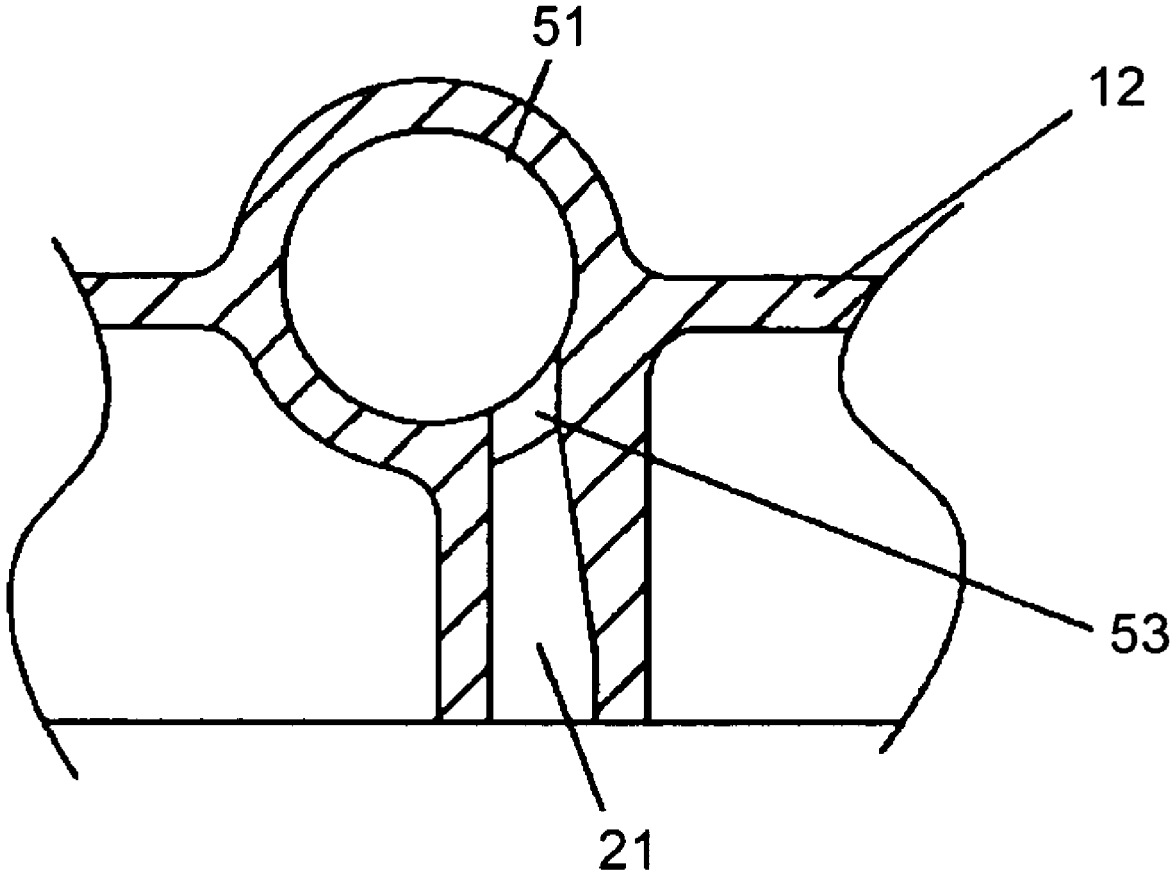
FIG. 7 is a lateral sectional view near the separation chamber showing another example of a slender passage of the preferred embodiment of FIG. 1.

A fourth factor is that slender passage 13A (see FIG. 1) and 21 (see FIG. 7) formed consecutively with feed hole 53 is provided in guide passage 13 for guiding refrigerant gas from discharge port 10 of the compressing mechanism to feed hole 53 and into separation chamber 51.

In this structure, this slender passage (13A and 21) performs an action of straightening refrigerant gas introduced into separation chamber 51. That is, disturbance or diffusion of flow of fluid flowing into separation chamber 51 can be suppressed. Moreover, not only static pressure of refrigerant gas of high pressure discharged from the compressing mechanism, but also dynamic pressure thereof, can be effectively utilized in revolution of refrigerant gas in separation chamber 51.

Four technical factors enabling to eliminate a separation pipe are explained. These plural technical factors can be combined, and combined effects of these technical factors are expected. Further, these individual technical factors of the preferred embodiment can be further combined with other technical elements.

In one example of the preferred embodiment, a circular columnar space is explained as a columnar space of the separation chamber. However, the columnar space may have any sectional shape as long as revolution of introduced refrigerant gas is not disturbed. For example, same effects are obtained by an elliptical section or a quadrilateral shape with round corners. A compressor having a centrifugal oil separation chamber of the invention can eliminate a need for a separation pipe in the oil separation chamber. Since a separation pipe is not needed, a space for installing the separation pipe in the separation chamber is not needed. As a result, the separation chamber is reduced in size. It is further possible to lower a manufacturing cost of a compressor due to fabrication and assembling of a separation pipe. Fluid in the compressor of the invention means gas containing misty liquid.

INDUSTRIAL APPLICABILITY

The invention is not limited to a sliding vane type rotary compressor, but may be applied also to a rolling piston type, scroll type, and other types of compressors.

The invention claimed is:

1. A compressor comprising:

a compressing mechanism for compressing a fluid that contains lubricating oil;

a separation chamber having an interior space that is to have revolved therein in a direction of revolution fluid compressed by said compressing mechanism such that at least part of the lubricating oil contained in the fluid is separated from the fluid by centrifugal force produced by revolution of the fluid within said interior space;

an exhaust hole at an upper end of said separator chamber for exhausting from said interior space the fluid compressed by said compressing mechanism after having been revolved in said interior space;

a feed hole for introducing into said interior space the fluid, compressed by said compressing mechanism, in a direction downwardly, with respect to a vertical axis of said separator chamber, away from said exhaust hole;

an oil-storage chamber for storing the lubricating oil separated from the fluid revolved in said interior space;

a communication passage provided between an upper part of said oil-storage chamber and said interior space, with said communication passage opening in a tangential direction of said interior space so that any fluid flowing into said interior space, via said communication passage, from said upper part of said oil-storage chamber is aligned with the direction of revolution at a point of introduction into said interior space; and a lubricating oil discharge hole at a lower end of said separation chamber, below where said feed hole and said communication passage open into said interior space.

2. A compressor comprising:

a compressing mechanism for compressing a fluid that contains lubricating oil;

a separation chamber having an interior space that is to have revolved therein fluid compressed by said compressing mechanism such that at least part of the lubricating oil contained in the fluid is separated from the fluid by centrifugal force produced by revolution of the fluid within said interior space;

an exhaust hole at an upper end of said separator chamber for exhausting from said interior space the fluid compressed by said compressing mechanism after having been revolved in said interior space;

a feed hole for introducing into said interior space the fluid, compressed by said compressing mechanism, in a direction downwardly, with respect to a vertical axis of said separator chamber, away from said exhaust hole, said feed hole being positioned eccentrically from a central axis of said interior space so that the fluid introduced into said interior space through said feed hole is guided in a circumferential direction of said interior space;

an oil-storage chamber for storing the lubricating oil separated from the fluid revolved in said interior space;

a communication passage provided between an upper part of said oil-storage chamber and said interior space, with said communication passage opening in said circumferential direction of said interior space so that any fluid flowing into said interior space, via said communication passage, from said upper part of said oil-storage chamber is introduced to flow in the same said circumferential direction, at a point of introduction into said separation chamber, as the fluid introduced into said interior space through said feed hole is flowing at said point of introduction.

* * * * *